US005282681A

United States Patent [19]

Supelak

[11] Patent Number: 5,282,681

[45] Date of Patent: Feb. 1, 1994

[54] PORTABLE AGITATOR FOR FLUIDIZING BOTTOM SOLIDS IN TANKS

[75] Inventor: Ralph A. Supelak, Strongsville, Ohio

[73] Assignees: Cadence Environmental Energy, Inc., Michigan City, Ind.; Ash Grove Cement Company, Overland Park, Kans.

[21] Appl. No.: 921,321

[22] Filed: Jul. 29, 1992

[51] Int. Cl.[5] ..... B01F 7/00

[52] U.S. Cl. ..... 366/246; 366/244; 366/262; 366/285; 366/292; 366/308

[58] Field of Search ..... 366/242, 244, 245, 246, 366/247, 249, 250, 251, 261, 279, 285, 292, 308, 331, 262

[56] References Cited

U.S. PATENT DOCUMENTS

| | | | |
|---|---|---|---|
| 292,590 | 1/1884 | Schafhaus | 366/308 |
| 385,151 | 6/1888 | Thompson | 366/308 |
| 1,218,623 | 3/1917 | Brillhart | 266/308 |
| 1,652,555 | 12/1927 | Bolton | 15/104.096 |
| 1,896,616 | 2/1933 | Gillican | 366/147 |
| 2,108,416 | 2/1938 | Smith et al. | 366/114 |
| 2,176,885 | 10/1939 | Cadwallader | 299/55 |
| 2,226,723 | 12/1940 | Joy | 366/154 |
| 2,859,020 | 11/1958 | Eddy et al. | 366/308 |
| 2,965,364 | 12/1960 | Parker et al. | 366/282 |
| 3,011,768 | 12/1961 | Clark | 366/285 |
| 3,111,954 | 11/1963 | Duncan | 366/330 |
| 3,132,850 | 5/1964 | Puchalski | 366/308 |
| 3,246,805 | 4/1966 | Kemp | 406/90 |
| 3,370,654 | 2/1968 | Skendrovic | 299/70 |
| 3,559,962 | 2/1971 | Enssle et al. | 366/308 |
| 3,697,053 | 10/1972 | Will | 366/343 |
| 4,431,597 | 2/1984 | Cramer et al. | 366/285 |
| 4,464,259 | 8/1984 | Cramer et al. | 366/286 |
| 4,511,257 | 4/1985 | Roberts | 366/262 |
| 4,519,714 | 5/1985 | Johnson et al. | 366/285 |
| 4,572,675 | 2/1986 | Roberts | 366/263 |
| 4,836,687 | 6/1989 | Kardoes et al. | 366/286 |

FOREIGN PATENT DOCUMENTS

| | | | |
|---|---|---|---|
| 0045235 | 2/1982 | European Pat. Off. | 366/249 |
| 0147223 | 10/1962 | U.S.S.R. | 15/246.5 |
| 0387009 | 10/1973 | U.S.S.R. . | |
| 1213501 | 11/1970 | United Kingdom . | |

OTHER PUBLICATIONS

Pit Hog® literature of Liquid Waste Technology of Somerset, Wis.

Drawing No. 2056, "Digester and Tank Mixing System", Liquid Waste Technology of Somerset, Wis.

Model-TC literature of Pro Quip, Inc. of Macedonia, Ohio.

*Primary Examiner*—Timothy F. Simone
*Assistant Examiner*—Reginald L. Alexander
*Attorney, Agent, or Firm*—Barnes & Thornburg

[57] ABSTRACT

A portable agitator is provided for fluidizing contents of a tank car that has settled during shipment. The agitator includes a column that can extend into a tank car through a manway, a wedging assembly for holding the column in place in the tank between the manway and the bottom wall of the tank, and a pivotable impeller platform appended to a distal end of the column. A pair of impellers are mounted on opposite ends of the impeller platform and are operable to stir and fluidize the contents of the tank car.

24 Claims, 5 Drawing Sheets

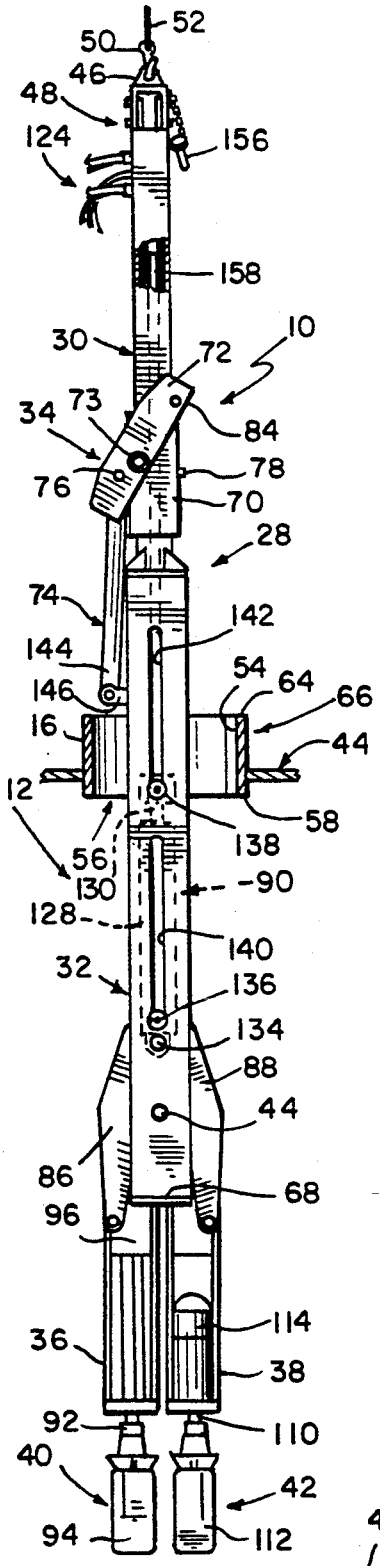
FIG. 3
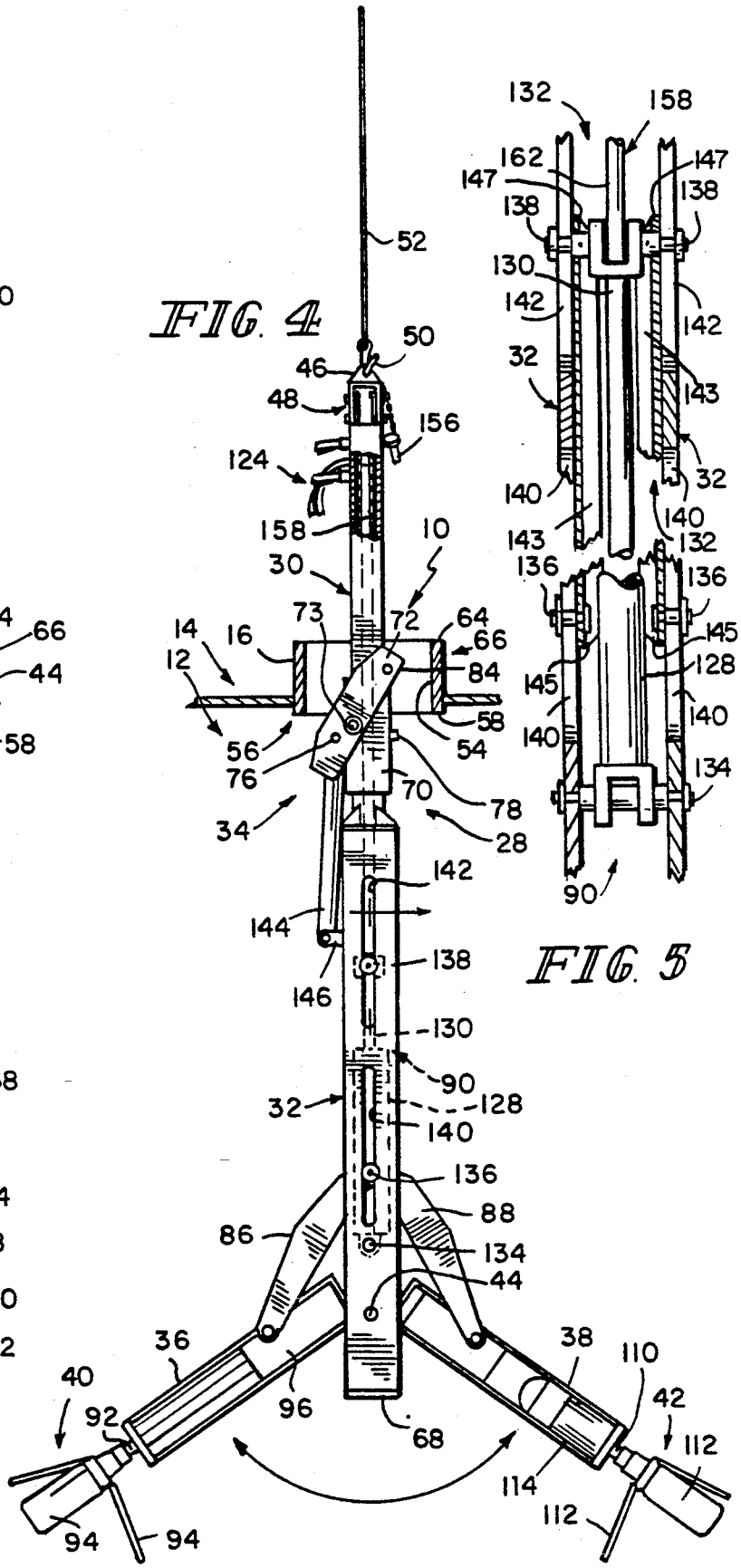
FIG. 4
FIG. 5

52
46
48
50
156
124
10
30
64
66
16
12
54
72
14
58
56
76
70
84
78
73
34
148
28
74
11
138
144
146
142
32
130
68
18
150
90
136
86
88
128
140
36
38
110
40
42
92
134
94
96
44
114
112

PORTABLE AGITATOR FOR FLUIDIZING BOTTOM SOLIDS IN TANKS

BACKGROUND AND SUMMARY OF THE INVENTION

This invention relates to agitators and resuspension units for stirring settled solids and liquids contained in tanks to produce a fluid slurry that can be pumped easily to empty the tank. More particularly, this invention relates to a portable agitator that can be lowered into a tank through a manway and operated to mix solids accumulating in the bottom of the tank with liquids in the tank to produce a free-flowing characteristically uniform fluid slurry.

It is well known that many materials contained in a mobile tank car will settle to the bottom of the tank during shipment. It can be difficult to pump settled solids out of a tank car at the time the tank car is being emptied of its contents. In practice, a mobile tank car is filled with both solid and liquid waste products obtained from one or more waste generators and transported by highway, rail, or water to a waste consumer who will empty the waste products from the tank car and then burn the waste products as a supplemental fuel. For example, waste products can include paints, solvents, resins, adhesives, inks, organic materials, and the like. A cement kiln facility is a typical consumer of waste products in that it is economical for a cement kiln operator to purchase waste products from a transporter and burn those waste products in the kiln as a supplemental fuel.

One problem experienced by transporters of waste products derives from the partial solidification, agglomeration, sedimentation, and/or precipitation of the waste homogenates in the tank cars during shipment. Although the waste product may be a homogenate, i.e., a fluid mixture of particles distributed somewhat evenly in a liquid, at the time the waste product is poured into the tank car, in many cases, that waste product will have separated into various layers or phases of solids, sediments, liquids, semisolids, and agglomerated materials by the time the tank car has reached its destination. It has been observed that some tank cars have arrived at a cement kiln facility with a significant portion of their contents in the form of a non-flowable, non-pumpable gel accumulated in the bottom of the tank car. This settling problem interferes with the unloading of the waste products from the tank car and also results in high costs for tank car cleaning services. Further, because there are numerous consumers of waste products at widely diverse geographical locations, construction and use of a single centrally located tank-emptying facility, including a provision of a permanent trackside or dockside tank agitator, is uneconomical and impractical.

An agitator that is portable and sized to be inserted through a tank manway for fluidizing and resuspending settled solids and liquids contained in the tank would advantageously enable a waste product transporter to mix and agitate the entire contents of the tank at the delivery site prior to and during unloading. A portable agitator that can be mounted directly to a mobile tank car would be an improvement over conventional agitators. Moreover, a portable agitator could be moved easily to each place where tank cars are to be unloaded using only common equipment such as a light truck and a small crane or other lifting device.

The present invention is an improved portable agitator that is able to agitate and fluidize multi-phase materials in a tank so as to resuspend sediments and break down agglomerates and cause the entire contents of the tank to be mixed thoroughly. The improved agitator is sized to extend into an interior region of a tank through a manway tube mounted on the tank. The manway tube includes an axially inner end lying adjacent to the tank and an axially outer end extending away from the tank.

According to the present invention, the improved portable agitator includes a frame, means for mixing solid and liquid material contained in the interior region of the tank to produce a free-flowing slurry, and means for selectively wedging against the axially inner end of the manway tube to anchor the frame and position the mixing means in the interior region of the tank. The mixing means and the wedging means are mounted on the frame. The agitator is operable to facilitate unloading of multi-phase materials in tanks and is engageable with the manway tube to stabilize the frame and the mixing means inside the tank.

In preferred embodiments, the portable agitator is configured to be lowered through the manway tube into the interior region of the tank so that the mixing means and the wedging means are positioned wholly inside the interior region of the tank. The mixing means includes one or more rotating impellers for fluidizing the semi-solid and solid materials contained in liquid stored in the tank. Advantageously, the portable agitator is operable to make it possible to unload tanks at faster rates and reduce variability of the character or chemistry of the material contained in the tank during the period of unloading such material from the tank.

Illustratively, the wedging means includes a locking arm and means for moving the locking arm relative to the frame against the axially inner end of the manway tube to press and stabilize the frame against the bottom wall of the tank. The locking arm moving means includes a sleeve mounted for vertical sliding movement on the frame. The locking arm is mounted on the sleeve to pivot between a vertical position nearly parallel to the central axis of the sleeve and a horizontal position perpendicular to the central axis of the sleeve. The locking arm includes an upper edge that is configured to seat against and mate with the bottom edge of the axially inner end of the manway tube to help anchor the frame and position the mixing means inside the tank.

The locking arm moving means also includes an upper hydraulic cylinder assembly or some other extensible member that is operable to raise and lower the sleeve on the frame and pivot the locking arm between its vertical and horizontal positions. This upper hydraulic cylinder assembly can be actuated by remote control to move the wedging means easily along the frame and inside the tank into and out of wedging engagement with the manway tube.

Also, in preferred embodiments, the mixing means includes two separate platforms pivotably connected to the frame and means for moving the platforms between projected positions extending in opposite directions along a line perpendicular to the longitudinal axis of the frame and retracted positions aligned in side-by-side spaced-apart parallel relation along lines parallel to the longitudinal axis of the frame. Illustratively, the platform moving means includes a lower hydraulic cylinder assembly or some other extensible member. This lower hydraulic cylinder assembly is mounted on the frame and attached by means of a mechanical linkage to two pivot arms which are pivoted by the lower hydraulic cylinder assembly to move the two separate platforms relative to the frame between projected and retracted positions.

An impeller is mounted at the distal end of each platform and operable to agitate material in the tank after the platforms have been moved to their projected positions and the wedging means has been actuated to retain the agitator in a stable position inside the tank. Further, a locking rod and key system is provided to enable a user to lock the two separate platforms mechanically in their projected positions by locking the frame to a locking rod connected to the lower hydraulic cylinder assembly so as to add to the stability of the agitator in the tank during use.

The agitator can be adjusted by remote control to assume a collapsed position streamlined along the length of the frame to make it easy for a user to lower the agitator into the tank through the narrow manway tube. Initially, the upper hydraulic cylinder assembly is actuated to pivot the locking arm to its vertical position and move the sleeve toward the mixing means to a lowered position so as to facilitate insertion of the locking arm and an upper portion of the frame into the interior region of the tank through the manway tube. At about the same time, the two impeller-carrying platforms are moved by the pivot arms and the lower hydraulic cylinder assembly to their retracted positions to facilitate insertion of the mixing means and a lower portion of the frame into the tank through the manway tube. An external winch and cable can be used to lower the collapsed agitator into the tank through the manway tube.

Once the lower portion of the frame is inserted into the interior region of the tank, the impeller-carrying platforms can be pivoted by the pivot arms and the lower hydraulic cylinder assembly relative to the frame to their projected positions so that the impellers face away from one another in opposite directions. The upper frame is then lowered further into the tank so that a foot of the frame rests on a bottom wall of the tank.

Next, the wedging means is actuated to help stabilize the agitator in the tank. The hydraulic cylinder assembly is actuated to pivot the locking arm to its horizontal position and move the sleeve toward the manway tube to a raised position. In this position, the locking arm extends in a direction transverse to the manway tube and is wedged against the annular bottom edge of the axially inner end of the manway tube to urge the frame downwardly in the tank so that the foot of the frame snugly engages a portion of the bottom wall of the tank centered under the manway tube. This wedging action advantageously stabilizes the frame inside the tank to enhance operation of the mixing means.

Finally, a key is used to lock the locking rod to the frame to lock the impeller-carrying platforms in their projected positions. Illustratively, the locking rod extends inside the frame along a part of its length and includes an inner end connected to the lower hydraulic cylinder assembly and an upper end projecting out of the manway tube to be accessible to a user located outside of the tank and holding a key. The key extends through a first slot formed in the frame and a second slot formed in the locking rod to hold the locking rod and keep the impeller-carrying platforms in their projected positions.

An impeller drive unit including a drive motor is mounted on each platform and configured to rotate the impellers to fluidize semisolid and solid contents of the tank. This fluidizing action reduces the multi-phase materials in the tank to produce a free-flowing fluid slurry that can be pumped easily through a conventional eductor tube to empty the tank. Each impeller includes a rotatable hub having a plurality of hinged collapsible blades. By properly wedging, anchoring, and stabilizing the portable agitator inside the tank, impeller motors having enough capacity to rotate the impellers to produce ultra-high mixing thrust can be used on the agitator. This makes it possible to operate the agitator to produce a free-flowing fluid slurry in the tank.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which:

FIG. 3 is an enlarged side elevation view of the portable agitator of FIG. 1 showing the axially extended configuration of the agitator as it is being inserted into a tank car through a manway tube wherein the locking arms are in their vertical position, the sleeve is in its lowered position, and the impeller-carrying platforms are in their retracted positions;

FIG. 4 is a view similar to FIG. 3 showing the configuration of the agitator during pivoting movement of the impeller-carrying platforms toward their projected positions;

FIG. 5 is an enlarged view taken along line 5—5 of FIG. 4 showing attachment of a pivot locking rod to a movable piston included in the lower hydraulic cylinder assembly and used to control pivoting movement of the impeller-carrying platforms relative to the frame;

DETAILED DESCRIPTION OF THE DRAWINGS

Figure 1:
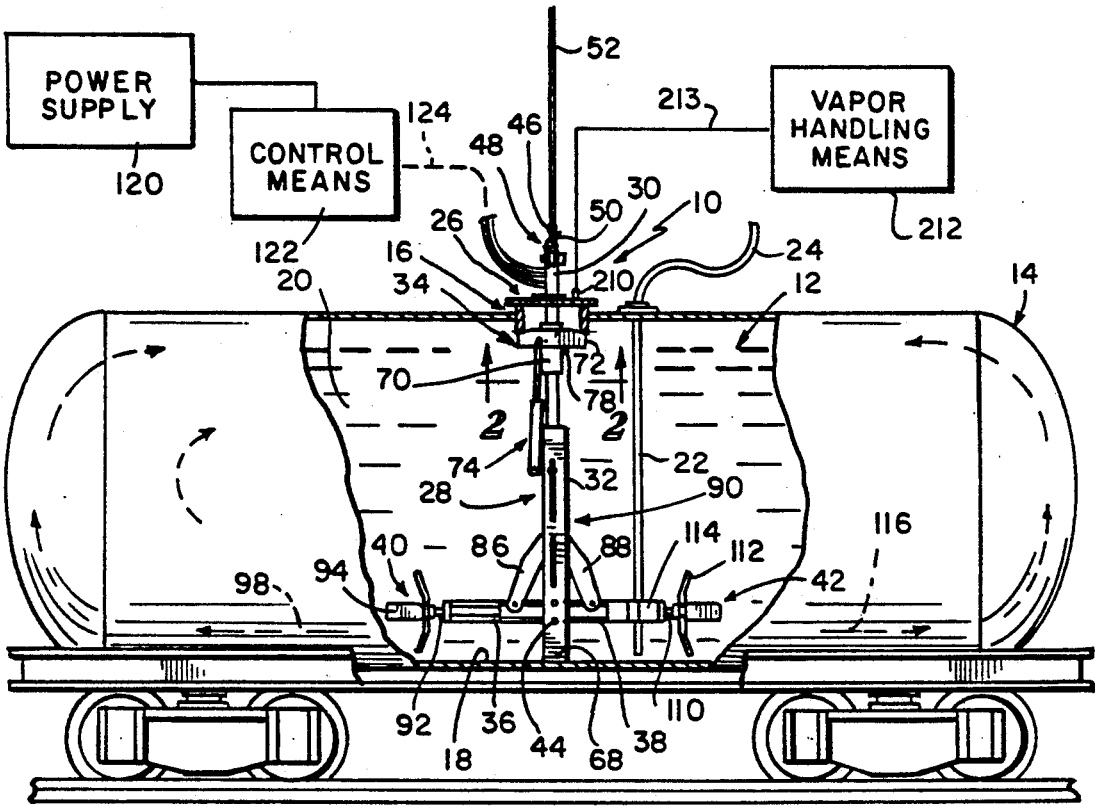
FIG. 1 is a side elevation view of a tank car containing a portable agitator in accordance with the invention with portions broken away to show the agitator wedged in place between a bottom wall of the tank car and an axially inner end of the manway tube to retain a pair of impellers and impeller drive units in a stable position inside the tank car.

The portable agitator 10 is easily lowered into the interior region 12 of tank car 14 or other vessel (not shown), locked in place in manway 16 of tank car 14, and operated by remote control to fluidize multi-phase material contained in the interior region 12 as shown in FIG. 1. The portable agitator 10 is used to disrupt bottom solids (not shown) that accumulate on bottom wall 18 inside tank car 14 and blend or mix these solids with liquids in the tank car 14 to produce a free-flowing, pumpable, homogenized slurry 20. In effect, agitator 10 fluidizes the multi-phase material in interior region 12 so that it can be pumped out of tank car 14 through the eductor tube 22 and outside hose 24 using a conventional pump (not shown). One advantage of using agitator 10 to fluidize material contained in interior region 12 prior to unloading is that the tank car 14 can be emptied of its contents more easily and completely. In this way, more of the tank car contents are salvaged for later processing, and subsequent clean-up of each emptied tank car 14 is more simple and less costly.

Referring to FIG. 1, portable agitator 10 includes a split manway cover 26, a vertical frame 28 including an upper column 30 and a lower column 32, a wedge assembly 34 mounted for movement on upper column 30, first and second impeller platforms 36, 38 pivotably connected to the lower column 32, and a pair of rotatable impellers 40, 42 mounted to the platforms 36, 38 to face in opposite directions. The first impeller 40 is mounted at the distal end of the first platform 36 and the second impeller 42 is mounted at the distal end of the second platform 38. The first and second platforms 36, 38 are connected to the lower column 32 at pivot point 44 for pivotable movement relative to lower column 32 and to one another so that impellers 40, 42 can be aimed at various angles other than just 180° apart in the manner shown in FIG. 1.

An eyelet bolt 46 or the like is mounted to the top end 48 of upper column 30. Bolt 46 is configured to receive a hook 50 appended to a winch cable 52 to permit a crane or other lifting device (not shown) to move the portable agitator 10 to the tank car 14 prior to unloading and lowering agitator 10 into the interior region 12 of tank car 14 through an open manway 16.

Figure 2:
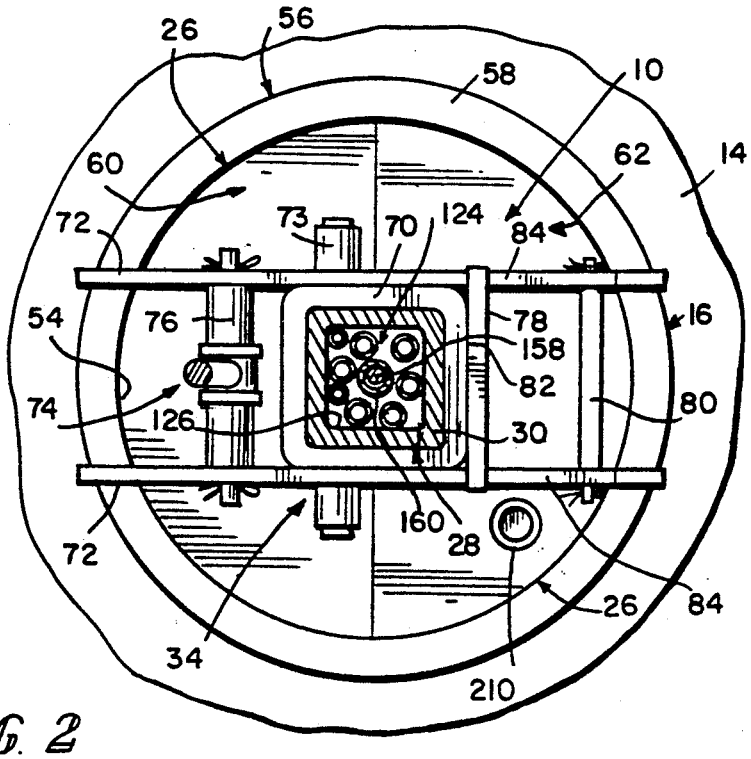
FIG. 2 is an enlarged cross-sectional view of the manway tube taken along line 2—2 of FIG. 1 showing a pair of pivotable locking arms arranged in spaced-apart parallel relation, attached to a sliding sleeve, and moved to engage the annular bottom edge of the axially inner end of the manway tube.

Referring to FIGS. 1 and 2, manway 16 is a tube including a cylindrical inner wall 54 defining an access port for receiving agitator 10 during insertion of agitator 10 into tank car 14. Manway tube 16 also includes an axially inner end 56 having a circular bottom edge 58 facing toward the bottom wall 18 of tank car 14. Split manway cover 16 includes a semicircular first cover 60 that mates with a semicircular second cover 62 and rests on a circular top edge 64 of an axially outer end 66 of manway tube 16 as shown in more detail in FIGS. 9 and 10.

The lower column 32 of frame 28 includes a foot 68 that is configured to seat on a portion of the bottom wall 18 of tank car 14 centered under manway tube 16. The foot 68 is sized and shaped to help support the weight of the agitator 10 once it is lowered to the working position inside the interior 12 of tank car 14 shown in FIG. 1.

The wedge assembly 34 includes a sleeve 70 mounted for sliding movement on the upper column 30 of frame 28 and a pair of locking arms 72 arranged in spaced-apart parallel relation and mounted to pivot pin 73 for pivoting movement on the sleeve 70. An upper hydraulic cylinder assembly 74 is provided for pivoting the locking arms 72 between vertical and horizontal positions and moving the sleeve 70 between raised and lowered positions. Illustratively, the upper hydraulic cylinder assembly 74 includes an extensible member that is coupled at its base to the lower column 32 and at its tip to a pivot pin 76 appended to the locking arms 72. As shown best in FIG. 2, pivot pin 76 cooperates with another cross member 80 to hold the pair of locking arms in fixed spaced-apart relation straddling the sleeve 70 and the upper column 30. Stop member 78 is fixed to a side wall 82 of sleeve 70 as shown in FIGS. 1 and 2 to engage the bottom edges 84 of locking arms 72 and thereby limit pivoting movement of the locking arms 72 relative to sleeve 70 to define the transverse, horizontal position of the locking arms 72.

Illustratively, another extensible member is used to control collapsing and unfolding of the pivoting first and second impeller-carrying platforms 36, 38. A pair of pivot arms 86, 88 and a lower hydraulic cylinder assembly 90 are provided for controlling pivoting movement of the first and second impeller platforms 36, 38 relative to the lower column 32 between projected and retracted positions. It will be understood that various pneumatic, mechanical, or electrical systems can be used in lieu of the various hydraulic systems described in this specification to move the movable components in portable agitator 10.

First impeller 40 includes a drive shaft 92 mounted for rotation to the left side of the first impeller platform 36 and a plurality of impeller blades 94 pivotably mounted to the drive shaft 92. Each impeller blade 94 is able to pivot toward and away from the longitudinal axis of rotation of drive shaft 92 so that the impeller blades 94 can move automatically under gravity to assume the collapsed position shown in FIG. 3 during insertion of the portable agitator 10 into the tank car 14. All of the blades 94 will move to the spread position shown in FIGS. 1 and 6 as soon as first impeller 40 begins to rotate.

A drive unit 96 is mounted inside the left end of first impeller platform 36 and connected to drive shaft 92. Drive unit 96 includes a heavy-duty impeller motor and is operable to rotate drive shaft 92 about its longitudinal axis of rotation, thereby causing the impeller blades 94 connected to drive shaft 92 to rotate and urge nearby liquids and solids in an outward direction 98 away from the first impeller platform 36 as shown in FIG. 1.

Second impeller 42 is similar in construction to first impeller 40 in that it includes a drive shaft 110 mounted for rotation to the right side of the second impeller platform 38 and a plurality of impeller blades 112 pivotably mounted to drive shaft 110. Each impeller blade 112 is able to pivot toward and away from the longitudinal axis of rotation of drive shaft 110 during pivoting movement of the second impeller platform 38 relative to lower column 32.

A drive unit 114 is mounted inside the right end of the second impeller platform 38 and connected to drive shaft 110. Drive unit 114 also includes a heavy-duty impeller motor and is operable to rotate drive shaft 110 about its longitudinal axis of rotation, thereby causing the impeller blades 112 connected to drive shaft 110 to rotate and urge nearby liquids and solids in an outward direction 116 away from the second impeller platform 38 as shown in FIG. 1. In a preferred embodiment, drive units 96 and 114 are operated so that drive shafts 92 and 110 rotate in opposite directions to establish a counter-rotating relationship between the left and right impellers 40, 42. Such a counter-rotating relationship helps to stabilize the impeller platforms 36, 38 during operation of impellers 40, 42 and permits the impellers 40, 42 to be operated to produce ultra-high mixing thrust. It is within the scope of this invention to operate drive units 96, 114 at different rates to cause the impellers 40, 42 to rotate independently and at different speeds. This can vary the mixing in the tank to affect flow dynamics within the tank. Also, if one impeller is hung up or obstructed, the other impeller can still be rotated.

Referring to FIGS. 1 and 2, a power supply 120 and control means 122 are provided to allow a user to operate the upper and lower hydraulic assemblies 74 and 90 by remote control. A plurality of hydraulic hose lines 124 are arranged to connect control means 122 to each of the upper and lower hydraulic assemblies 74 and 90. Preferably, these hose lines 124 are enclosed in a passage 126 that is provided inside frame 28 and sealed to the environment by a silicone and polyurethane combination. Accordingly, the agitator 10 may be operated without problem while the agitator 10 is fully dry, fully submerged in liquid, or partly submerged in liquid. Each hydraulic assembly 74 and 90 includes sealed hydraulic cylinders and motors and is compatible with a wide range of chemicals. In a presently preferred embodiment, the control means 122 includes a plurality of electric solenoid valves (not shown) that are normally powered by power supply 120 and that can also be switched manually.

In use, a fully collapsed portable agitator 10 can be lowered into the interior region 12 of tank car 14 through the access port provided in manway tube 16 as shown in FIG. 3. Once the agitator 10 is lowered to about the position shown in FIG. 4, the lower hydraulic cylinder assembly 90 can be actuated to pivot the impeller-carrying platforms 36, 38 outwardly toward their projected positions.

Illustratively, the lower hydraulic cylinder assembly 90 includes a fixed cylinder 128 and a movable piston 130. Piston 130 is mounted for reciprocatinq movement inside an internal passageway 132 formed in lower column 32. Cylinder 128 has one end fixed to lower column 32 at mount 134. Guide pins 136, 138 are coupled to lower hydraulic cylinder assembly 90 as shown in FIG. 5 and arranged to slide in the two axially spaced-apart vertical slots 140, 142 formed in lower column 32. Guide pins 136, 138 help to control sliding movement of the piston 130 as it reciprocates in internal passageway 132 along the length of lower column 32 during pivoting movement of the impeller-carrying platforms 36, 38 about pivot point 44.

Figures 6, 7:
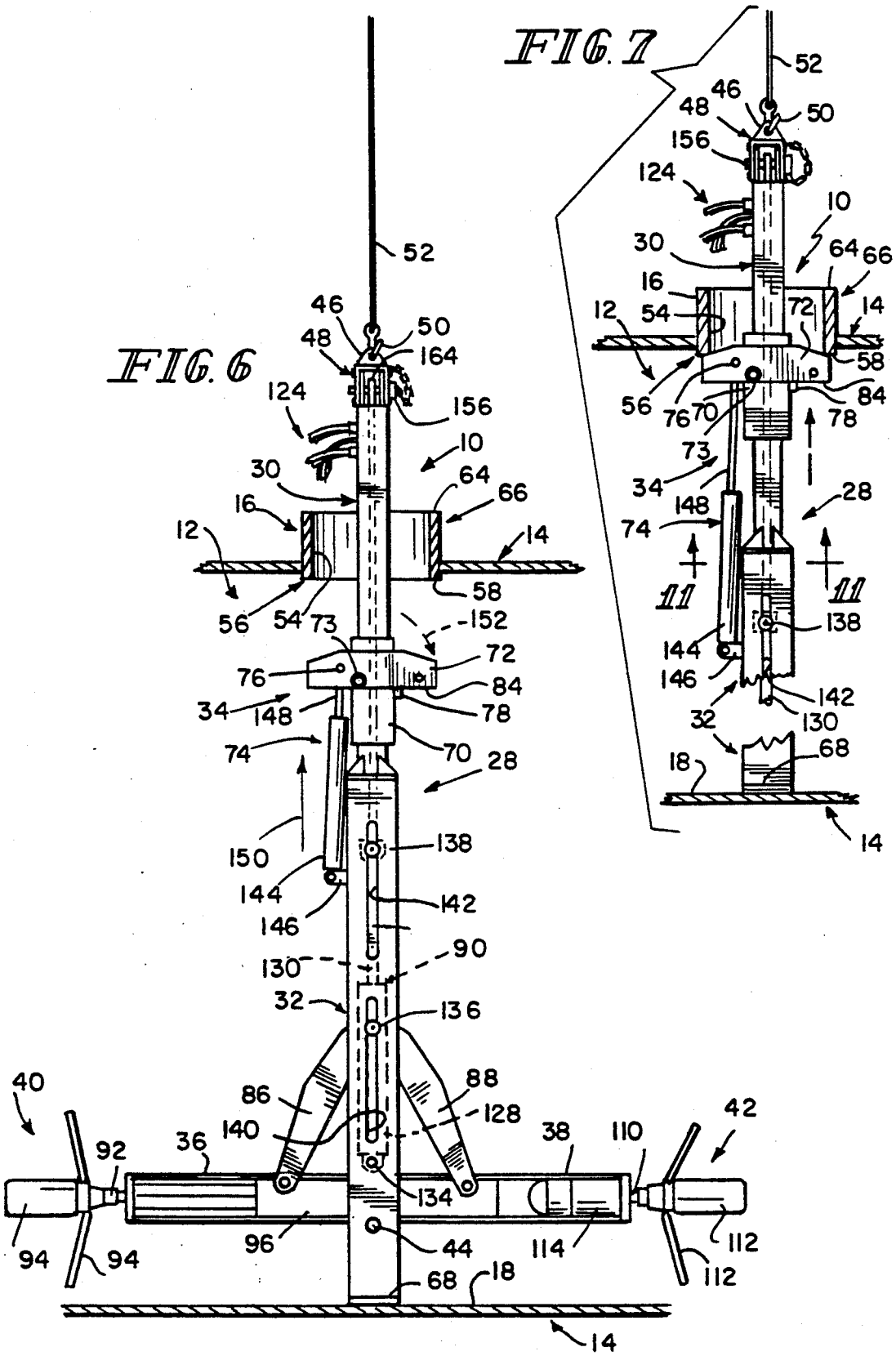
FIG. 6 is a view similar to FIGS. 3 and 4 showing the configuration of the agitator after the impeller-carrying platforms have been pivoted to their projected positions, the foot of the frame has been seated on the bottom wall of the tank car, and the upper hydraulic cylinder assembly has been actuated to pivot the locking arms to their horizontal positions without moving the sleeve upwardly on the frame.
FIG. 7 is a view similar to FIGS. 3, 4, and 6 but after upward movement of the sleeve relative to the frame to its raised position to retain the locking arms in engagement with the bottom edge of the axially inner end of the manway tube and thereby retain the front of the frame in snug engagement with the bottom wall of the tank.

The agitator 10 is unfolded further to the position shown in FIG. 6 by using the lower hydraulic cylinder assembly 90 to pivot the impeller-carrying platforms 36, 38 to their projected positions. Referring to FIG. 5, a pair of lift arms 143 are provided to swing the pivot arms 86, 88 in and out (as shown in FIG. 4) in response to movement of the piston 130 up and down in the lower column 32. Each lift arm 143 includes a lower end 145 coupled to one of the guide pins 136 and an upper end 147 coupled to one of the other guide pins 138. These left arms 143 serve to connect the distal end of the movable piston 130 and the upper guide pins 138 to the pivot arms 86, 88. The agitator 10 is unfolded by actuating the lower hydraulic cylinder assembly 90 to move the piston 130 up with respect to cylinder 128, which causes upper guide pins 138 and the two lift arms 143 attached to guide pins 138 also to move up toward manway 16. The lift arms 143 are thus raised to move lower guide pins 136 upwardly in lower slots 140, thereby lifting the upper ends of the pivot arms 86, 88 and causing the pivot arms 86, 88 to lift the impeller-carrying platforms 36, 38 such that those platforms 36, 38 pivot about pivot point 44 as shown in FIG. 4. The agitator 10 is collapsed by reversing of the foregoing steps.

The agitator 10 is then lowered further to cause the foot 68 on the bottom end of lower column 32 to engage the bottom wall 18 of tank 14 as shown in FIGS. 6 and 7. The foot 68 is centered underneath the manway tube 16 and sized to support the frame 28 as the wedge assembly 34 is moved by the upper hydraulic cylinder assembly 174 into engagement with the axially inner end 56 of manway tube 16 as shown in FIGS. 6 and 7.

Illustratively, the upper hydraulic cylinder assembly 74 includes a fixed cylinder 144 and a movable piston 148. Cylinder 144 has one end pivotably mounted to a bracket 146 appended to lower column 32 and piston 148 has a head extending into cylinder 144 and a rod pivotably coupled to the pivot pin cross member 76 joining the two locking arms 72 as shown best in FIGS. 2 and 6.

The wedge assembly 34 is moved from its vertical position shown in FIG. 4 to its horizontal position engaging manway 16 as shown in FIG. 7 in the following manner. First, when the agitator 10 has been lowered to the position shown in FIG. 6, the upper hydraulic cylinder 74 is actuated to project piston 148 in direction 150 a first distance out of fixed cylinder 144 to cause the locking arms 72 to pivot about pivot pin 73 from the vertical position shown in FIG. 4 in direction 152 to assume the horizontal position shown in FIG. 6. During such pivoting, the sleeve 70 remains in its lowered position on upper column 30 as shown in FIGS. 4 and 6. Next, the piston 148 is projected further out of fixed cylinder 144 to cause the locking arms 72 and the sleeve 70 to move upwardly in direction 154 to the raised position shown in FIG. 7. In this raised position, the tapered top edges of the two locking arms 72 engage the circular bottom edge 58 of the axially inner end 56 of manway tube 16 as shown in FIGS. 2 and 7. By using the upper hydraulic cylinder assembly 74 to load the tapered edges of the locking arms 72 against manway tube 16, it is possible to center the agitator 10 in manway tube 16 and wedge the frame 28 in a snug position between manway tube 16 and tank floor 18 without permanently deforming either the manway tube 16 or the tank floor 18. This wedging action serves to stabilize the frame 28 and the agitator components mounted on the frame 28 in a secure upright position to enhance operation of the agitator 10 during use.

Figure 8:
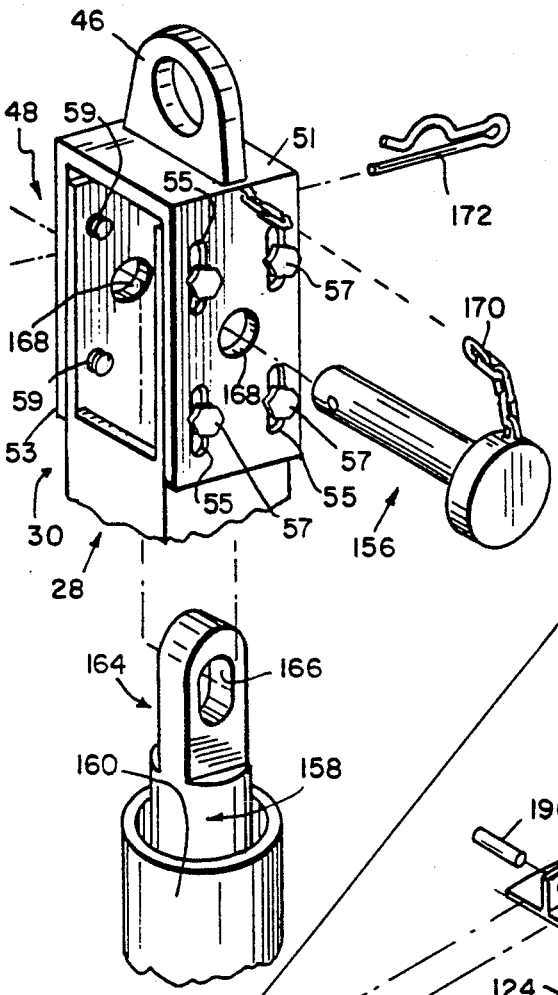
FIG. 8 is an enlarged perspective view of the locking rod and key assembly shown in FIGS. 1, 3, 4, 6, and 7 prior to insertion of a key into a slot formed in the locking rod to retain the impeller-carrying platforms in their projected positions as shown in FIG. 6.

Referring back to FIG. 6 and ahead to FIG. 8, it will be seen that a locking key 156 can be used to connect a pivot locking rod 158 to the frame 28 so as to lock the impeller-carrying platforms 36, 38 in their projected positions. Pivot locking rod 158 is mounted for reciprocating movement in a vertical rod sleeve 160 as shown in FIGS. 8 and 10–12. The rod sleeve 160 is mounted to lie inside internal passageways 126, 132 formed in the upper and lower columns. As shown best in FIG. 5, a bottom end 162 of pivot locking rod 158 is coupled to the distal end of piston rod 130 at upper guide pins 138. As shown best in FIG. 8, a top end 164 of pivot locking rod 158 is formed to include a key-receiving slot 166 and a lift tab assembly 49, which assembly 49 is coupled to the top end of upper column 30 and is formed to include a pair of key-receiving apertures 168. A chain 170 is provided to tether the key 156 to the frame 28 and a cotter pin 172 is provided to retain the key 156 in its impeller platform-locking position passing through slot 166 and apertures 168 as shown in FIGS. 1, 6, and 7.

In effect, the key 156 operates to block movement of pivot locking rod 158 and movable cylinder 128 relative to the frame 28. This serves to lock the impeller platforms 36, 38 in their projected position because the movable piston 130 is connected to the impeller platforms 36, 38 directly by a linkage comprising the first and second pivot arms 86, 88, the lower guide pins 136, the lift arms 143, and the upper guide pins 138 which are coupled to movable piston 130.

As shown in FIG. 8, the lift tab assembly 49 includes a central lift tab plate 51 and a pair of spaced-apart parallel lift tab bolt plates 53. Each bolt plate 53 is formed to include a plurality of elongated bolt-receiving slots 55. Bolts 57 extend through slots 55 and into apertures 59 formed in top end 48 of upper column 30. These bolts 57 can be tightened to lock the lift tab assembly 49 in place on the upper column 30. By raising and lowering assembly 49 on column 30, it is possible to vary the included angle between the impeller-carrying platforms 36, 38 in their locked positions because of the change in position of the pivot-locking rod 158. In other words, by adjusting the lift tab assembly 49 up or down on the upper column 30, it is possible to change the pinning location of pin 156 up or down from the location shown in FIG. 8 to vary the position of the impellers and platforms between angled positions above or below the horizontal position shown in FIG. 6.

Figure 9:
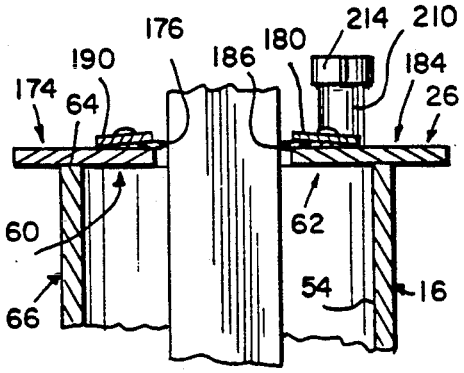
FIG. 9 is an enlarged side elevation view of a manway tube cover of the type shown in FIG. 1.
Figure 10:
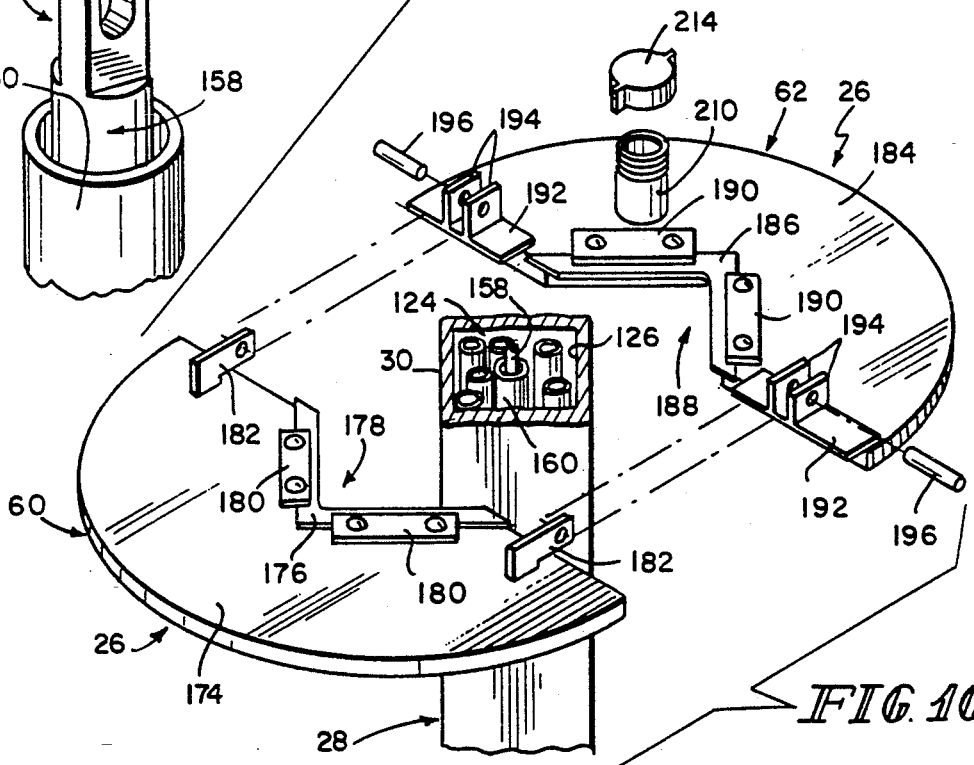
FIG. 10 is an enlarged perspective view of the two-piece manway tube cover shown in FIGS. 1 and 9 prior to installation on the frame.

The configuration and assembly of the split manway cover 26 is illustrated in FIGS. 9 and 10. As noted previously, cover 26 includes a first cover 60 and a second cover 62. The first cover 60 includes a notched semicircular plate 174 including an L-shaped flexible sealing gasket 176 attached to the plate 174 to border the notch 178 by hold-down plates 180 and a pair of spaced-apart cover tabs 182. The second cover 62 includes a notched semicircular plate 184 including an L-shaped flexible sealing gasket 186 attached to the plate 174 to border the notch 188 by hold-down plates 190. A mounting plate 192 including a spaced-apart pair of upright tabs 194 is mounted along the straight side of plate 184 on either side of the notch 188 to mate with the cover tabs 182 upon movement of the plates 174, 184 to abut one another. A locking pin 196 can be passed through apertures 198 formed in tabs 182, 194 to hold the covers 60, 62 in abutting sealing relation on the top of the manway tube 16.

A vapor discharge outlet 210 is mounted on the second cover 62 to conduct various vapors extant in the interior region 12 of tank 14 to a vapor handling means 212 (FIG. 1) through a conduit 213 during operation of the agitator 10 in tank 14. A threaded cap 214 is provided to close vapor discharge outlet 210 until it becomes necessary to vent the tank 14 to the vapor handling means 212.

Figure 11:
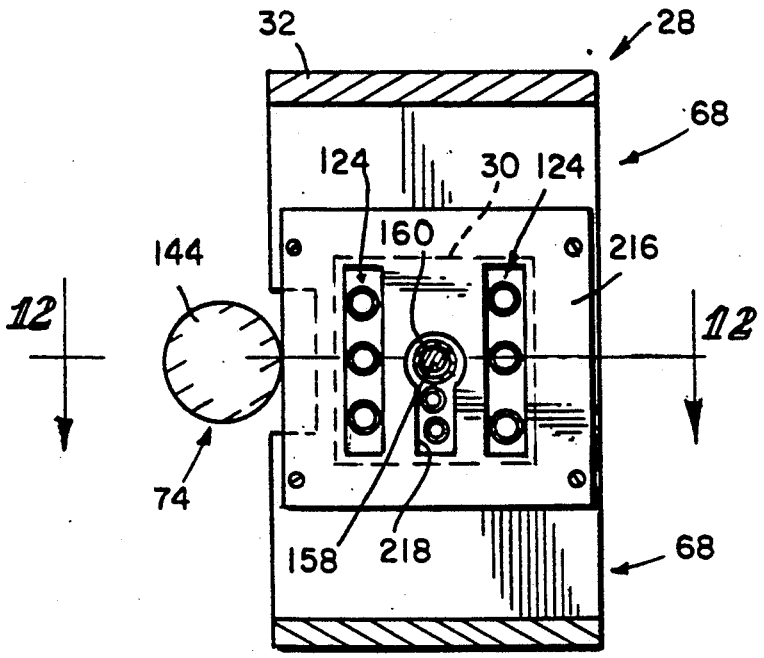
FIG. 11 is a section taken along line 11—11 of FIG. 7.
Figure 12:
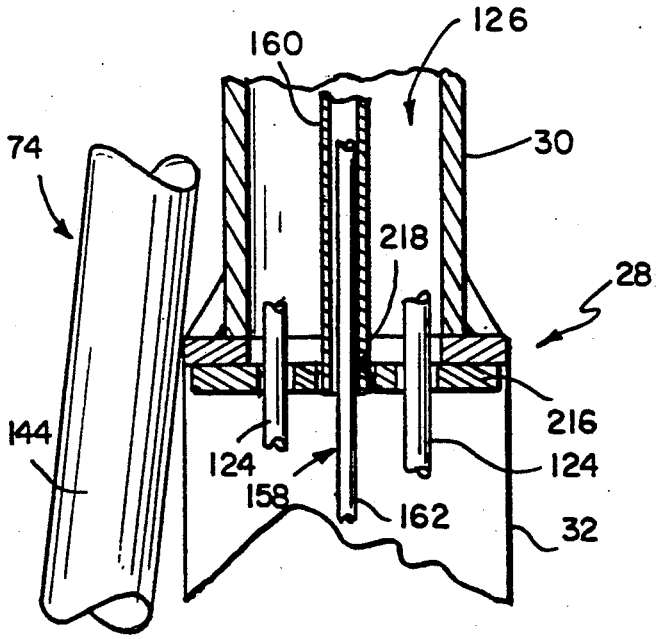
FIG. 12 is a section taken along line 12—12 of FIG. 11.

The connection of the upper column 30 to the lower column 32 to provide the upright frame or mast 28 is illustrated in FIGS. 11 and 12. A cap 216 is provided inside lower column 32 to organize and arrange the hydraulic hose lines 124 and the pivot locking rod 158 and rod sleeve 160 passing between the two columns 30, 32. The lower end of rod sleeve 160 terminates in a central slot 218 formed in cap 216 as shown in FIG. 12.

In practice, to use the portable agitator 10 it is necessary to spot and block the tank car 14, hook grounding to the tank car 14, and vent and open the tank car manway 16. The agitator 10 is swung on a crane or the like to lie over the access port in manway tube 16. Preferably, the agitator 10 is oriented diagonally to place the impellers 40, 42 at 5 o'clock and 11 o'clock if, when looking down on the access port opening, the 12 o'clock position is toward a long end of the tank car 14. The agitator 10 is then lowered (about eight feet) into the tank car 14 until the locking arms 72 line up with the top edge of the manway 16.

The impeller-carrying platforms 36, 38 are then pivoted upwardly to assume their projected positions as shown in FIGS. 6 and 7. The agitator 10 is then rotated about the longitudinal axis of the vertical frame 28 to contact any vertical obstructions (e.g., valve stems and siphon pipes) present in the interior region 12 of tank car 14. If no obstructions are detected, the agitator 10 is rotated to line up the impeller platforms 36, 38 along the long center line of tank car 14. The wedge assembly 34 is then used to wedge frame 28 securely in place between the manway tube 16 and the tank floor 18.

The two-piece split closure plate 26 is then installed around the upper column 32 to close and seal the opening in manway tube 16. Now the vapor lines are connected and the impellers 40, 42 are then turned on to mix the contents of the tank car 14 thoroughly.

Although the invention has been described in detail with reference to certain preferred embodiments, variations, and modifications exist within the scope and spirit of the invention as described and defined in the following claims.

I claim:

1. A portable agitator for extending into an interior region of a tank through a manway tube mounted on the tank to fluidize material contained in the tank, the manway tube including an axially inner end lying adjacent to the tank and an axially outer end extending away from the tank, the agitator comprising a frame, means for mixing solid and liquid material contained in the interior region of the tank to produce a pumpable slurry while the frame is in the tank, the mixing means being mounted on the frame, means for wedging only against the axially inner end of the manway tube to anchor the frame and position the mixing means in the interior region of the tank while the frame is in the tank, the wedging means being mounted on the frame, and means for moving the wedging means relative to the frame.

2. A portable agitator for extending into an interior region of a tank through a manway tube mounted on the tank to fluidize material contained in the tank, the manway tube including an axially inner end lying adjacent to the tank and an axially outer end extending away from the tank, the agitator comprising a frame, means for mixing solid and liquid material contained in the interior region of the tank to produce a pumpable slurry while the frame is in the tank, the mixing means being mounted on the frame, and means for anchoring the frame to position the mixing means in the interior region of the tank while the frame is in the tank, the anchoring means being mounted on the frame, the tank including a bottom wall, the anchoring means including a locking arm and means for moving the locking arm relative to the frame to wedge the locking arm against the axially inner end of the manway tube while the frame is in the tank to press the frame downwardly against the bottom wall of the tank, and the moving means being positioned to lie inside the tank while the frame is in the tank.

3. The agitator of claim 2, wherein the axially inner end of the manway tube includes a downwardly facing annular rim and the locking arm includes means for acting against the downwardly facing annular rim to urge the frame downwardly into snug engagement with the bottom wall of the tank during operation of the moving means to stabilize the frame and mixing means within the interior region of the tank.

4. The agitator of claim 2, wherein the moving means includes means for supporting the locking arm for pivoting movement relative to the frame to facilitate insertion of the locking arm into the interior region through the manway tube and means for raising and lowering the supporting means relative to the frame to move the locking arm between a raised position engaging the axially inner end of the manway tube and a lowered position disengaging the axially inner end of the manway tube.

5. A portable agitator for extending into an interior region of a tank through a manway tube mounted on the tank to fluidize material contained in the tank, the manway tube including an axially inner end lying within the tank and an axially outer end extending away from the tank, the agitator comprising a frame, means for mixing solid and liquid material contained in the interior region of the tank to produce a pumpable slurry, the mixing means being mounted on the frame, and means for anchoring the frame to position the mixing means in the interior region of the tank while the frame is in the tank, the anchoring means being mounted on the frame, the anchoring means including a sleeve mounted for sliding movement on the frame and a locking arm pivotably coupled to the sleeve for pivotable movement about a horizontal pivot axis between an engaged position engaging the axially inner end of the manway tube and a disengaged position disengaging the axially inner end of the manway tube and the locking arm includes means for wedging against the axially inner end of the manway tube upon movement of the locking arm to its engaged position.

6. The agitator of claim 5, wherein the anchoring means further includes an extensible member having one end coupled to the frame and another end coupled to the locking arm and means for actuating the extensible member to move the locking arm between its engaged and disengaged positions.

7. The agitator of claim 5, wherein the anchoring means further includes means for raising and lowering the sleeve and locking arm relative to the frame to move the locking arm between a raised position engaging the axially inner end of the manway tube and a lowered position disengaging the axially inner end of the manway tube.

8. A portable agitator for extending into an interior region of a tank through a manway tube mounted on the tank to fluidize material contained in the tank, the manway tube including an axially inner end lying adjacent to the tank and an axially outer end extending away from the tank, the agitator comprising a frame, means for mixing solid and liquid material contained in the interior region of the tank to produce a pumpable slurry, the mixing means being mounted on the frame, and means for anchoring the frame to position the mixing means in the interior region of the tank while the frame is in the tank, the anchoring means including a wedge assembly and means for moving the wedge assembly relative to the frame and inside the interior region of the tank between a locked position engaging only the axially inner end of the manway tube and an unlocked position disengaging the manway tube, and the moving means being mounted on the frame to lie between the mixing means and the wedge assembly.

9. The agitator of claim 8, wherein the moving means includes an extensible member having one end coupled to the frame and another end coupled to the wedge assembly and means for actuating the extensible member to move the wedge assembly between its locked and unlocked positions while the frame and mixing means are positioned inside the interior region of the tank.

10. The agitator of claim 9, wherein the extensible member is a hydraulic cylinder assembly having a cylinder coupled to the frame, a movable piston coupled to the wedge assembly, and power means for moving the piston relative to the cylinder to move the wedge assembly relative to the frame.

11. The agitator of claim 8, wherein the wedge assembly includes a pair of locking arms arranged to lie in spaced-apart parallel relation, a pair of cross members extending between the pair of locking arms to hold the locking arms in a fixed position and define a central aperture between the locking arms and the cross members, the frame is arranged to extend through the central aperture, and the moving means is coupled to the frame and to one of the cross members.

12. The agitator of claim 11, wherein the wedge assembly further includes means for supporting the locking arms and cross members for movement along the frame in directions toward and away from the manway tube in response to operation of the moving means.

13. The agitator of claim 12, wherein the supporting means includes a sleeve mounted for sliding movement on the frame and means for pivotably connecting the locking arms to the sleeve.

14. The agitator of claim 11, wherein the wedge assembly further includes a cylindrical sleeve mounted for sliding movement on the frame and arranged to extend through the central aperture and to surround a portion of the frame extending through the central aperture and means for pivotably mounting the locking arms to the sleeve.

15. The agitator of claim 8, wherein the axially inner end of the manway tube includes an annular rim and the wedge assembly includes means for acting against the annular rim upon movement of the wedge assembly to its locked position to urge the frame downwardly into snug engagement with an interior wall of the tank to stabilize the frame inside the interior region of the tank during operation of the mixing means.

16. The agitator of claim 15, wherein the acting means includes a locking arm having an annular rim-engaging surface and a length greater than the internal diameter of the manway tube and means for pivoting the locking arm between a vertical position parallel to the longitudinal axis of the frame and a horizontal position perpendicular to the longitudinal axis of the frame so that in its vertical position the locking arm is oriented alongside the frame to permit the frame and the locking arm to be lowered into the interior region of the tank and in its horizontal position the locking arm is oriented to position its annular rim-engaging surface inside the interior region of the tank in confronting relation to the annular rim on the axially inner end of the manway tube.

17. The agitator of claim 16, wherein the moving means includes a sleeve mounted for sliding movement on the frame and an extensible member having one end coupled to the frame and another end coupled to the locking arms and the pivoting means is coupled to the sleeve to carry the pivotable locking arms on the sleeve during extension and retraction of the extensible member.

18. A portable agitator for extending into an interior region of a tank through a manway tube mounted on the tank to fluidize material contained in the tank, the manway tube including an axially inner end lying adjacent to the tank and an axially outer end extending away from the tank, the agitator comprising a frame, means for mixing solid and liquid material contained in the interior region of the tank to produce a pumpable slurry, the mixing means being mounted on the frame, and means for anchoring the frame to position the mixing means in the interior region of the tank while the frame is in the tank, the anchoring means being mounted on the frame, the tank includes a bottom wall, the frame includes foot means for engaging the bottom wall to stabilize the frame in the interior region of the tank, and the anchoring means includes a locking arm and means for moving the locking arm relative to the frame into wedging engagement with the axially inner end of the manway tube to urge the foot means downwardly relative to the locking arm and against the bottom wall of the tank so that the frame is wedged between the manway tube and the bottom wall in a stable upright position within the interior region of the tank during operation of the mixing means.

19. The agitator of claim 18, wherein the moving means includes a sleeve mounted for sliding movement on the frame and the locking arm is pivotably coupled to the sleeve.

20. The agitator of claim 19, wherein the moving means further an extensible member having one end coupled to the frame and another end coupled to the locking arm and means for actuating the extensible member to move the locking arm between an engaged position engaging the axially inner end of the manway tube and a disengaged position disengaging the axially inner end of the manway tube.

21. The agitator of claim 19, wherein the moving means further includes means for selectively sliding the sleeve on the frame upwardly toward the manway tube to raise and pivot the locking arm into wedging engagement with the axially inner end of the manway tube and downwardly toward the bottom wall of the tank to lower and pivot the locking arm to a position disengaging the axially inner end of the manway tube.

22. The agitator of claim 21, wherein the sliding means includes an extensible member having one end coupled to the frame and another end coupled to the locking arm and means for actuating the extensible member to move the locking arm between an engaging position engaging the axially inner end of the manway tube and a disengaged position disengaging the axially inner end of the manway tube.

23. The agitator of claim 18, wherein the locking arm is mounted for pivotable movement relative to the frame and the moving means includes an extensible member having one end coupled to the frame and another end pivotably coupled to the locking arm.

24. A portable agitator for extending into an interior region of a tank through a manway tube mounted on the tank to fluidize material contained in the tank, the manway tube including an axially inner end lying adjacent to the tank and an axially outer end extending away from the tank, the agitator comprising a frame, means for mixing solid and liquid material contained in the interior region of the tank to produce a pumpable slurry, the mixing means being mounted on the frame, and means for wedging against the axially inner end of the manway tube to anchor the frame and position the mixing means in the interior region of the tank, the wedging means being mounted on the frame, the tank includes a bottom wall, the frame includes foot means for engaging the bottom wall to stabilize the frame in the interior region of the tank, and the wedging means includes a locking arm and means for moving the locking arm relative to the frame into wedging engagement with the axially inner end of the manway tube to urge the foot means downwardly relative to the locking arm and against the bottom wall of the tank so that the frame is wedged between the manway tube and the bottom wall in a stable upright position within the interior region of the tank during operation of the mixing means, the locking arm is mounted for pivotable movement relative to the frame and the moving means includes an extensible member having one end coupled to the frame and another end pivotably coupled to the locking arm, and the moving means further includes a sleeve mounted on the frame for sliding movement relative to the frame between a lowered position away from the manway tube and a raised position adjacent to the manway tube, means for pivotably coupling the locking arm to the sleeve for pivotable movement between a vertical position parallel to the sleeve and a horizontal position perpendicular to the sleeve to facilitate insertion of the locking arm into the interior region through the manway tube, and actuator means for moving the extensible member between a retracted position arranging the sleeve in its lowered position and the locking arm in its vertical position and a projected position arranging the sleeve in its raised position and the locking arm in its horizontal position so that the extensible member operates by remote control to raise the sleeve and locking arm and then pivot the locking arm relative to the sleeve to establish wedging engagement between the locking arm and the axially inner end of the manway tube upon movement of the extensible member to its projected position.

* * * * *